United States Patent [19]

Bean et al.

[11] Patent Number: 4,681,426

[45] Date of Patent: Jul. 21, 1987

[54] BRUSH END SEALS FOR BLADE CLEANER HOUSING

[75] Inventors: Lloyd F. Bean, Rochester; Richard L. Forbes, II, Pittsford; Joseph A. Swift, Ontario; Bruce E. Thorp, Walworth, all of N.Y.

[73] Assignee: Xerox Corporation, Stamford, Conn.

[21] Appl. No.: 864,694

[22] Filed: May 19, 1986

[51] Int. Cl.[4] ..... G03G 15/08

[52] U.S. Cl. ..... 355/15; 355/3 DD; 355/14 D; 118/652; 430/125

[58] Field of Search ..... 355/15, 3 R, 3 DD, 14 D; 118/652, 654; 430/125

[56] References Cited

U.S. PATENT DOCUMENTS

| | | | |
|---|---|---|---|
| 3,633,544 | 1/1972 | Weller | 118/654 X |
| 3,863,603 | 2/1975 | Buckley et al. | 118/637 |
| 3,872,826 | 3/1975 | Hanson | 118/8 |
| 3,918,808 | 11/1975 | Narita | 355/15 |
| 4,302,494 | 11/1981 | Horton | 428/95 |
| 4,400,082 | 8/1983 | Kiba | 355/15 |

OTHER PUBLICATIONS

XDJ-Vol. 8, No. 3, May/Jun. 1983, p. 259.

XDJ-vol. 10, No. 4, Jul./Aug. 1985, pp. 233-234.

*Primary Examiner*—A. C. Prescott

[57] ABSTRACT

Cleaner apparatus for electrostatographic reproducing apparatus comprises a cleaning blade in cleaning engagement with the endless charge retentive surface and end seals at each end of the charge retentive surface comprising a dense fibrous brush of resiliently flexible fibers fixed to a backing with the fibers being oriented in compression interference sealing contact with the charge retentive surface and in sealing engagement with the ends of the cleaning blade to provide a physical containment wall for bulk toner in the cleaner housing and a seal between the wall and the charge retentive surface.

12 Claims, 11 Drawing Figures

10
12
13
14
15
16
17
18
19
20
21
22
24
26
27
28
30
32
34
36
37
38
39
40
42
44
46
47
48
50
52
54

BRUSH END SEALS FOR BLADE CLEANER HOUSING

CROSS REFERENCE TO RELATED APPLICATION

Reference is made to copending application Ser. No. 623,067, entitled Blade Cleaning Apparatus for Removing Toner From A Charge-Retentive Surface filed June 22, 1984 now U.S. Pat. No. 4,564,283 in the name of Wayne D. Fox et al., and to copending application Ser. No. 813,183, entitled Blade Cleaning Apparatus for Flexible Belt filed on Dec. 20, 1985 in the name of Richard L. Forbes et al.

BACKGROUND OF THE INVENTION

The present invention relates to electrostatographic reproducing apparatus and more particularly to cleaning apparatus for removing and storing residual toner cleaned from an imaging surface used therein.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

In commercial applications several different types of techniques have been used in the prior art to clean and store residual toner material remaining on the imaging surface following transfer of the toner image to the copy sheet. For example, rotating brushes and cleaning webs have been used to remove the toner from the imaging surface. In addition magnetic brushes have been used in the cleaning of an imaging surface of magnetically attractable toner particles. Furthermore, blade cleaners have become increasingly popular in recent years due to their simplicity in construction and high degree of effectiveness in removing residual toner. Cleaning blades may be used in either a wiping or a chiseling configuration. To insure continuous operation of automatic reproducing equipment using electrostatographic processes, it is necessary that any cleaned toner material from the photoreceptor be contained within the cleaning housing and not distributed throughout the machine. Loose toner particles throughout the machne can be contaminates with regard to corona charging devices, and the imaging slit, for example, and may appear as background deposits on the photoreceptor and may otherwise tend to foul mechanical operation of the machine resulting in poor quality copies produced from the apparatus. Accordingly, there has been a long desire to seal off the toner contained within the cleaner housing.

PRIOR ART

Several devices have been used in the prior art for this purpose. It is known, for example, to use brushes to block the flow of toner laden air so that the air escaping from the cleaning area is substantially free of toner material. In the Xerox 1075 duplicator, a brush seal is provided between the development system and the photoreceptor belt. In this development system a paddle wheel at the bottom of the developer sump acts as a pump and tends to produce a powder cloud of toner at the top near the development zone. The brush seal is used to prevent the powder cloud from escaping the development zone into the remainder of the machine. This brush seal is used in the path of the toner laden air by screening out the toner and permitting the air to go through the seal. The brush seal that is used in the Xerox 1075 development system comprises a fibrous brush of resiliently flexible fibers fixed to a backing, like the brush material to be described hereinafter with respect to the present invention. It is also known to use foam seals at the edge of the cleaner housing. However, it has been found with time that these foam seals tend to tak a set and thereby lose their sealing force. When this happens the toner can get trapped under the foam and the friction force between the foam seal and the photoreceptor may cause toner to roll out of the cleaner onto the photoreceptor surface.

Xerox Disclosure Journal, Volume 10, No 4, July/August 1985 - discloses the use of a pair of fibrous seals mounted on the end of a blade cleaning apparatus to block the air flow created in the cleaner housing and causing the toner laden air to be redirected behind the blade 10. As a result, the velocity of air is significantly lowered and the toner is enabled to fall out of the air and into the bottom of the cleaner housing. The fibers disclosed are fabricated from polypropylene are at least ¾ of an inch long and 0.001 inch in diameter. Further the fibers are directed to the blade cleaner axially parallel to the photoreceptor drum. The same disclosure appears in the above noted copending application.

U.S. Pat. No. 3,872,826 (Hanson) - FIGS. 3 and 4 illustrate cleaner housings wherein the end seals 106 are positioned on either side of the developer housing and are comprised of a strip of polyethylene foam which has a top seal across the width of the photoreceptor with a plurality of outwardly extending fibers in the form of a brush. Outward flow of toner particles outside the cleaner housing is thereby restricted.

SUMMARY OF THE INVENTION

In a principal aspect of the present invention an electrostatographic reproducing apparatus is provided with a cleaner housing for removing and collecting residual toner on a charge retentive surface which comprises a residual toner sump, a cleaning blade and means to support the cleaning blade in engagement with the charge retentive surface and end seals at each end of the charge retentive surface, said end seals comprising a dense fibrous brush of resiliently flexible fibers fixed to a backing, the fibers being oriented in compression interference sealing contact with the charge retentive surface and in sealing engagement with the ends of the cleaning blade to provide a physical containment wall for both toner and the cleaning housing and a seal between the wall and the charge retentive surface.

In a further aspect of the present invention the brush end seals have a fiber fill density of from about 5,000 to about 10,000 filaments per linear inch and, from about 15,000 to about 30,000 filaments per square inch.

In a further aspect of the present invention the brush end seal pile is oriented perpendicular to the brush backing.

In a further aspect of the present invention the charge retentive surface comprises an endless flexible belt supported for movement between two support members defining a substantially horizontal top run therebetween and the cleaner apparatus is positioned within said horizontal top run.

In an additional aspect of the present invention the ends of the fibrous brush are splayed in interference sealing contact with the belt which is supported under the top run by a cleaning platen in opposed relationship to the cleaning blade.

DESCRIPTION OF THE PREFERRED EMBODIMENT

Figure 1:
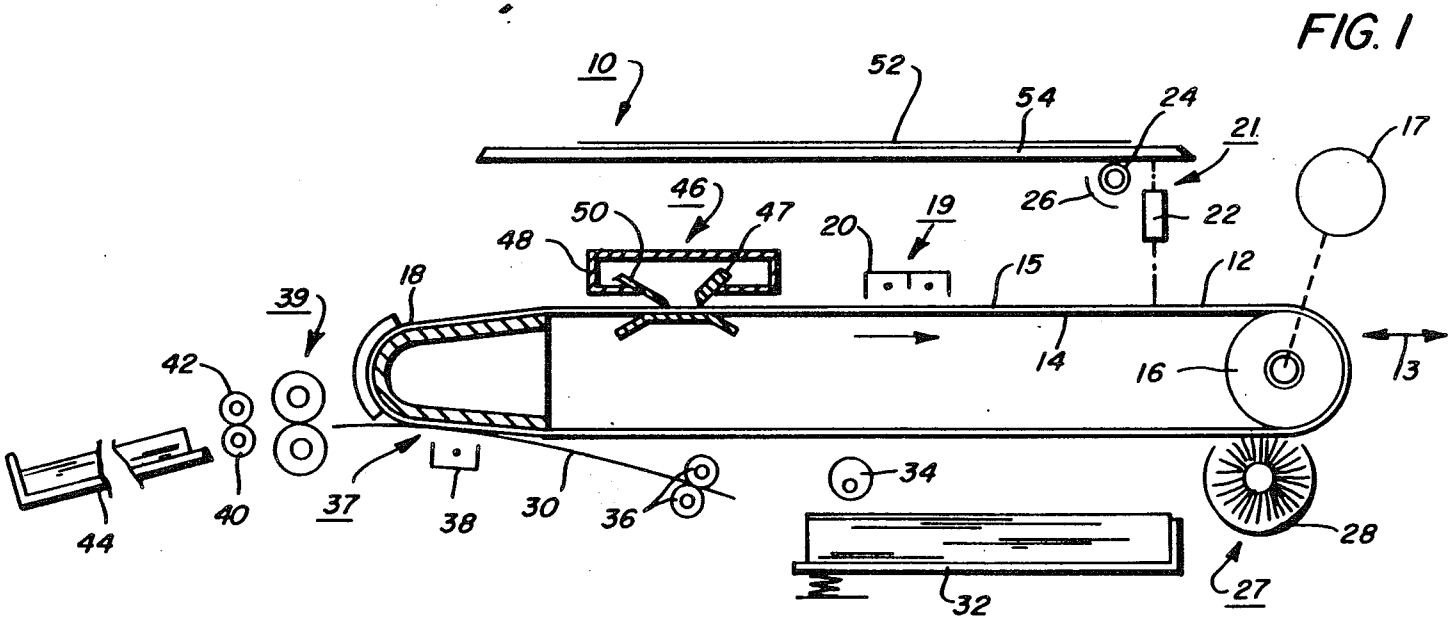
FIG. 1 is a schematic representation in cross section of an automatic electrostatographic reproducing machine with the brush end seals according to the present invention included therein.

Referring now to FIG. 1, there is shown by way of example, an automatic electrostatographic reproducing machine 10 which includes a removable processing cartridge employing the brush end seals according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around belt tracking shoe 18 and travels in the direction indicated by the arrows on the inner run of the belts to bring the image bearing surface thereon past the plurality of xerographic processing stations. Suitable drive means such as motor 17 are provided to power and coordinate the motion of the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The exposure station 21 may comprise a bundle of imge transmitting fiber lenses 22 produced under the tradename of "SELFOC" by Nippon Sheet Glass Company Limited, together with an illuminating lamp 24 and a reflector 26. After exposure of the belt 15 the electrostatic latent image recorded on the photoconductive surface 15 is transported to development station 27, wherein developer is applied to the photoconductive surface of the drum 15 rendering the latent image visible. Suitable development station could include a magnetic brush development system including developer roll 28, utilizing a magnetizable developer mix having course magnetic carrier granules and toner colorant particles.

Sheets 30 of the final support material are supported in a stack arrangement on elevated stack support tray 32. With the stack at its elevated position, the sheet separator segmented feed roll 34, feeds individual sheets therefrom to the registration pinch roll pair 36. The sheet is then forwarded to the transfer station 37 in proper registration with image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, with the sheet containing the toner image thereon which is advanced to fixing station 39 wherein roll fuser 40 fixes the transferred powder image thereto. After fusing the toner image to the copy sheet, the sheet 30 is advanced to output rolls 42 to sheet stacking tray 44.

Although a preponderance of toner powder is transferred to the final support material 30, invariably some residual toner remains on the photoconductive surface 15 after the transfer of the toner powder image of the final support material. The residual toner particles remaining on the photoconductive surface after the transfer operation is removed from the belt 14 by the cleaning station 46 which comprises a cleaning blade 47 in scrapping contact with the outer periphery of the belt 14 and contained within cleaning housing 48 which has a cleaning seal 50 associated with the upstream opening of the cleaning housing.

Normally when the copier is operated in the conventional mode, the original document 52 to be reproduced is placed image side down upon a horizontal transport viewing platen 54 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 2:
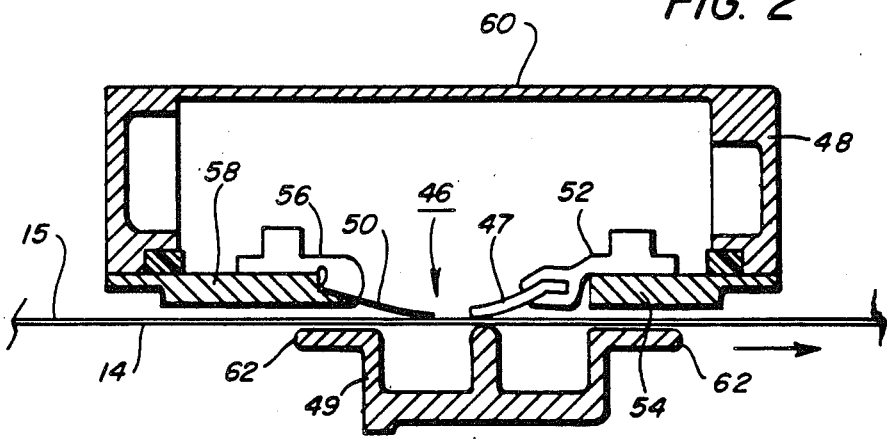
FIG. 2 is an enlarged schematic representation in cross section of the blade cleaning assembly according to the present invention.
Figure 3:
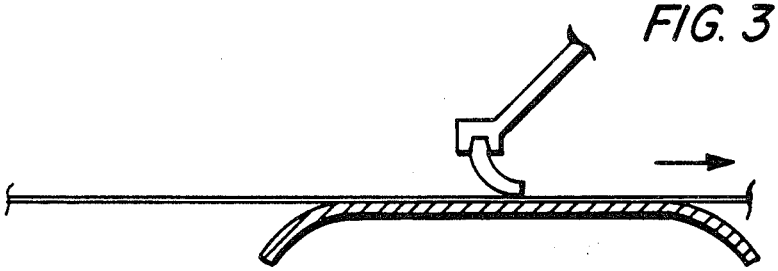
FIG. 3 is an alternative embodiment illustrating a wiping blade in opposed relationship to a horizontal platen surface.
Figure 4:
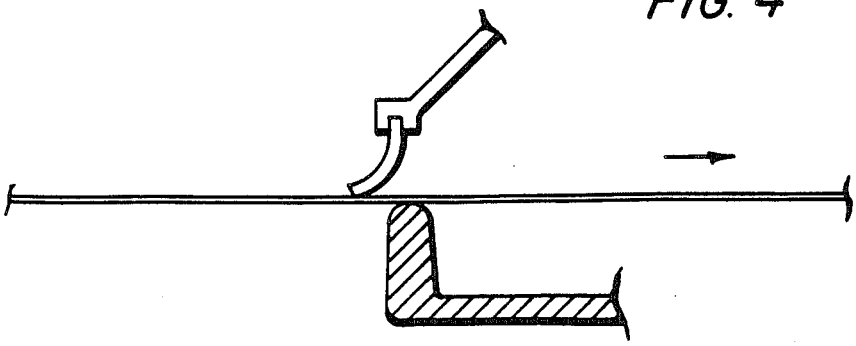
FIG. 4 is an alternative embodiment illustrating a chiseling blade positioned upstream in the process direction of the cleaning blade.
Figure 5:
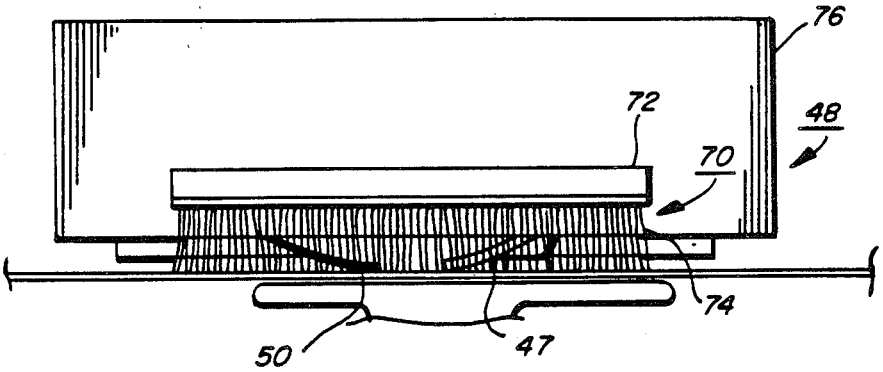
FIG. 5 is a view from one side of the cleaner housing to the other side of the cleaner housing illustrating the position of the brush end seal with respect to the photoreceptor and the cleaning blade.

The cleaning station will be described with additional reference to FIG. 2 wherein the photoreceptor belt 14 having a photoconductive insulating surface 15 thereon is transported in the direction of the arrow through the cleaning station. The cleaning station 46 comprises a cleaning platen 49 positioned under the top horizontal run of the imaging belt 14 with a cleaning housing 48 in opposed relationship on the top run of the photoconductive belt 14. Contained within the cleaner housing is a cleaning blade 47 rigidly held in blade holder 52 which is mounted to blade mount 54 which in turn is mounted to the cleaning housing 48. The cleaning blade 47 by virtue of its position and beam deflection is in opposed interference relationship with the top surface of belt 14 supported by cleaning platen 49. Cleaning seal 50 is held by seal holder 56 which is mounted to seal mount 58 upstream in the process direction of the cleaning blade. The seal in contact with the photoreceptor 14 insures that toner cleaned from the photoreceptor by the cleaning blade 47 does not escape in the upstream direction from the cleaning housing 48. As the photoreceptor 14 travels in the direction of the arrow, any residual toner remaining thereon is cleaned or scrapped from the imaging surface by the blade 47 and transported into the cleaning sump 60. Also illustrated in FIG. 2 are structural members 62 which may be used to optionally provide additional guidance of the photoreceptor belt during transport to the cleaning station. It should be noted that the cleaning blade, cleaning platen, cleaning seal together with the cleaning housing are at least as wide as the imaging area of the photoreceptor belt. In FIG. 2, the cleaning blade 47 is in a chiseling orientation with regard to the advancing photoreceptor belt. As the belt moves in the direction indicated by the arrow, the tip of the blade 47 chisels any residual toner from the surface of the belt and pushes it up into the cleaner sump 60. An alternative embodiment is that illustrated in FIG. 3 wherein the cleaning blade is in a wiping orientation with respect to the advancing photoreceptor belt. Also illustrated in FIG. 3 is a cleaning platen forming a larger area in opposed relationship to the cleaning blade. The alternative embodiment illustrated in FIG. 4 illustrates the tip of the cleaning blade being positioned from 2 to 5 mm upstream in the direction of the leading edge of the cleaning platen.

In operation in either the chiseling or wiping mode the cleaning blade which is mounted in opposed fixed relationship to the cleaning platen on the opposite side of the imaging surface, uses pressure interference engagement with the photoconductive surface of the belt by means of its beam deflection to provide the force required to clean the imaging surface of toner. In addition, in view of the orientation of the cleaning blade at roughly the twelve o'clock position, toner material which has been loosened and cleaned from the imaging surface remains in the nip between the cleaning blade and the imaging surface and lubricates the surface of the nip so that the leading edge or tip of the cleaning blade does not tuck under the main body of the cleaning blade thereby causing cleaning failures. The cleaning blade may be made of any suitable materials such as metal or plastic but preferably is made from an elastomer such as urethane. The cleaning seal may be made from a suitable material such as polyurethane, cellulose acetate or Mylar.

The brush end seal according to the present invention will be described with further reference to FIGS. 5–8 wherein end seals 70 positioned on the inboard and the outboard side of the photoreceptor belt comprise a backing 72 and a plurality of resiliently flexible fibers 74 fixed thereto to form a dense fibrous brush. Brush 70 is mounted fixedly to plate 76 at both the inboard and the outboard side of the cleaner housing 48. The fibers of the brush are oriented in compression interference sealing contact with the photoreceptor and in sealing engagement with the ends of the cleaning blade 47 to provide a physical containment wall for toner in the cleaner housing and a seal between the wall and the photoreceptor. This may be illustrated further with reference to FIG. 8 which shows the cleaner housing having been in operation for some portion of time in order to collect considerable mass of toner therein. As viewed, the collected toner resides in the cleaner housing in the space 60 formed between the flap seal, photoreceptor belt, cleaning blade and the cleaner housing itself with the ends being sealed off by means of the present brush end seal. Of course, in addition to collecting residual toner, the cleaner housing cleans the photoreceptor of and collects paper debris and some carrier beads that may have been carried over through the development zone.

Figure 6A:
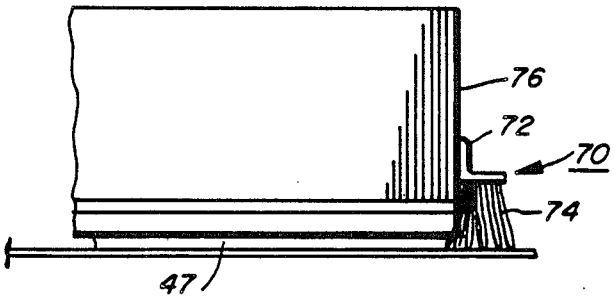
FIGS. 6A and 6B are end and top views respectively of the brush end seal configuration, illustrating the position of the brush with respect to the photoreceptor and the cleaning blade.
Figure 6B:
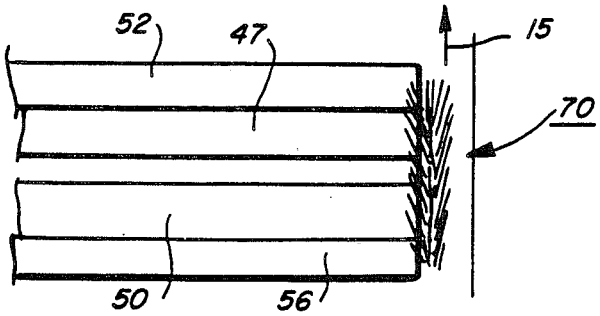
Figure 7:
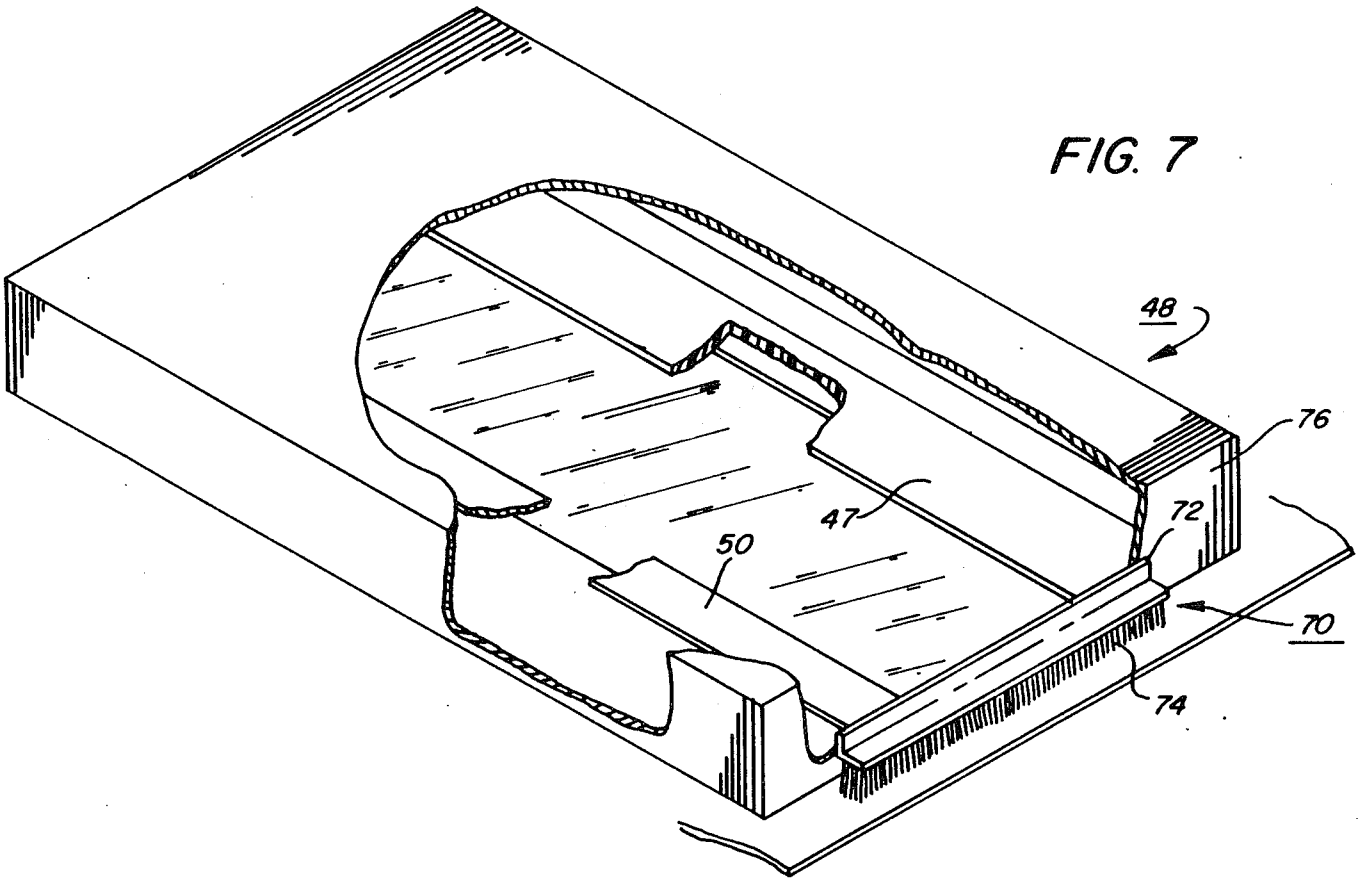
FIG. 7 is an isometric view of the brush end seal
Figure 8:
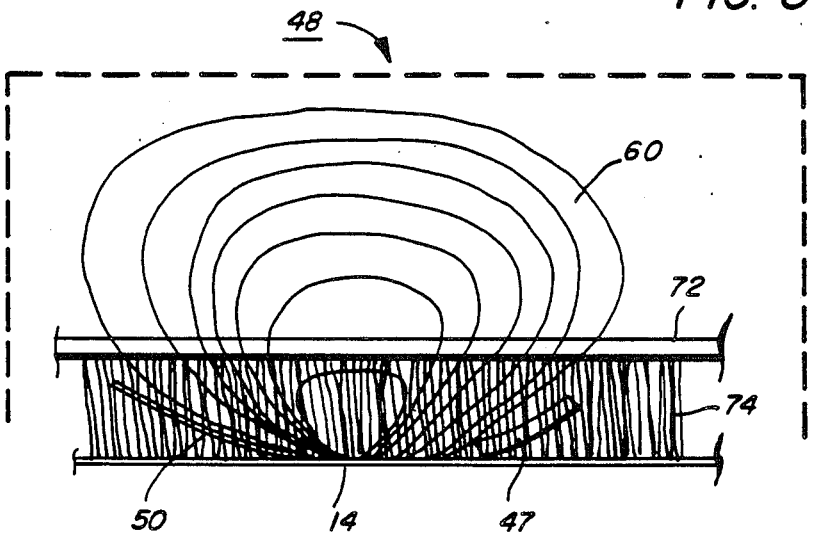
FIG. 8 is a schematic illustration of the cleaner housing after it has been in operation for a considerable period of time and contains a large mass of bulk quantities of toner therein.

As illustrated in FIGS. 6A & B, the individual ends of the brush are splayed out providing an angled surface such that when toner particles approach the brush bristles they are deflected back into the main toner area. Typically the brush end seals have a fiber fill density of from about 15,000 to about 30,000 filaments per square inch and with this high fiber fill density there is a propensity for the brush to store toner, and this tends to make the brush self sealing. The brush can be made of any suitable natural or synthetic fibers which are not hydroscopic. Typical materials include polyethylene, nylon, polypropylene, acrylics. Polypropylene is preferred because of its ready availability and ease of processing. Fibers may be solid or hollow and of any particular cross section such as round, multiloble, flat, triangular, etc. Round fibers are preferred because they are readily available and low in cost. Furthermore the fibers should be preferably continuous filament yarn to minimize shedding. Typically the brush end seals comprise from about 90 to about 110 yarn ends per linear inch with each yarn end comprising from about 60 to about 80 filaments per yarn of filaments of having from about 12 to about 20 denier per filament. In a preferred embodiment a brush comprises about 100 yarn ends per linear inch with each yarn end comprising about 70 filaments per yarn of filaments having 15 denier per filament. Typically the brushes are about a quarter to about one half inch in width with a fiber length of from about one quarter inch to about one half inch. In addition to the above physical properties the brush fiber should be toner and photoreceptor compatible and stable to the atmosphere within the copying machine. The brush end seals may be made with any suitable technique and may, for example, be woven or manufactured as illustrated in U.S. Pat No. 4,302,494 wherein backing strips of thermal plastic material are continuously fed along the edges of an endless traveling band and are ultrasonically welded to the yarn which is thereafter slit along the side of the band to provide a pair of continuous pile brushes. Preferably the brushes are made from continuous filament yarns which are texturized by inserting a multiplicity of permanent crimps to the filaments. The waviness of the filament, may be obtained by application of heat in a constrained area such as a stuffer box as is well known in the art. Typically individual filaments have from about 4 to about 10 crimps per inch with each crimp having an amplitude of 0.010 to 0.025 inches. With the individual filaments being crimped the void volume of the brushes is irregular and the total void volume is less than the brushes made with uncrimped or straight fiber. Accordingly, crimped fibers provide better sealing of the photoreceptor and the cleaning blade.

Figure 9:
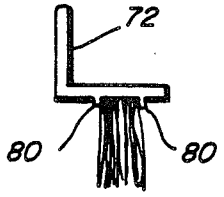
FIGS. 9 and 10 are alternative embodiments of the brush configuration.
Figure 10:
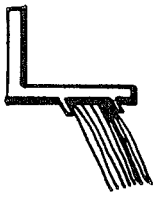

FIGS. 9 and 10 illustrate two alternative embodiments of the brush configuration. In FIG. 9, the brush pile is perpendicularly oriented relative to the backing 72 contained within flange members 80 of the backing. In other words a perpendicular line through the center of the mass of the brush will bisect the mass. FIG. 10 shows an alternative embodiment wherein the brush may be angled so that the perpendicular line to the base through the mass does not bisect the fiber mass.

Thus according to the present invention a cleaning system for use in an electrostatographic imaging apparatus is provided with seals on both sides thereof which function as physical containment walls for both toner and the cleaner housing as well as the seal between the wall and the photoreceptor. The brush design is very simple, containing a large mass of residual toner held within the cleaning sump of the cleaning housing. This brush has unique application in that as illustrated it may be used in the twelve o'clock position wherein a large mass of toner is contained and collected while in contact with the photoreceptor. This is in contrast to cleaning stations which may be used at the three, six and nine o'clock position wherein the force of gravity enables the toner to fall into a cleaning sump. The brush end seals used in the Xerox 1075 as previously indicated filter toner particles from escaping from the developer housing. The present invention provides brush end seal that functions totally unexpectedly to seal off contained bulk quantities of toner. In fixture testing of a cleaning housing as illustrated in the present invention after the production of 35,000 copies and the collection of considerable quantity of toner in the cleaning housing the total leakage rate observed from the cleaner housing was zero.

The disclosures of the patents and application referred to herein are hereby specifically and totally incorporated herein by reference.

While the invention has been described with reference to specific embodiments, it will be apparent to those skilled in the art that many alternatives, modifications and variations may be made. For example, while the invention has been illustrated with an electrostatic latent image formed by the exposure of an electrostatically charged photoconductive member to light image of an original document, the electrostatic latent image may alternatively be generated from information electronically stored or generated in digital form which may afterward be converted to alpha-numeric images by image generation and electronics and optics. Accordingly it is intended to embrace all such alternatives and modifications that may fall within the spirit and scope of the appended claims.

What is claimed is:

1. In an electrostatographic reproducing apparatus comprising a charge retentive surface movable through an endless path, a cleaner apparatus for removing and collecting residual toner from said charge retentive surface comprising an enclosed cleaner housing including a residual toner sump, a cleaning blade and means to support the blade edge in cleaning engagement with the charge retentive surface and end seals at each end of said charge retentive surface, said end seals comprising a dense fibrous brush of resiliently flexible fibers fixed to a backing, said fibers being oriented in compression interference sealing contact with said charge retentive surface and in sealing engagement with the ends of said cleaning blade to provide a physical containment wall for bulk toner in the cleaner housing and a seal between the wall and the charge retentive surface.

2. The apparatus of claim 1, wherein said brush end seals have fiber fill density of from about 15,000 to about 30,000 filaments per square inch.

3. The apparatus of claim 1, wherein said brush end seals comprise from about 90 to about 110 yarn ends per linear inch with each yarn end comprising from about 60 to about 80 filaments per yarn of filaments having from about 12 to about 20 denier per filament.

4. The apparatus of claim 3, wherein said brush comprises about 100 yarn ends per linear inch with each yarn end comprising about 70 filaments per yarn of filaments having 15 denier per filament.

5. The apparatus of claim 1, wherein said brush is made of polyproylene fibers.

6. The apparatus of claim 1, wherein the brush pile is oriented perpendicular to the brush backing.

7. The apparatus of claim 1, wherein the brush pile is oriented at an angle to the perpendicular to the brush backing.

8. The apparatus of claim 1, wherein said charge retentive surface comprises an endless flexible belt supported for movement between two support members defining a substantially horizontal top run therebetween, said cleaner apparatus being positioned on top of said horizontal top run.

9. The apparatus of claim 8, wherein the ends of said fibrous brush are splayed in interference sealing contact with said belt.

10. The apparatus of claim 8, including a cleaning platen under the top run of said belt between said support members for supporting said belt thereon in opposed relationship to said cleaning blade.

11. The apparatus of claim 10, wherein said cleaning blade is rigidly mounted with said cleaner housing and including a flexible flap seal mounted in said cleaner housing upstream of said cleaning blade in the process direction and in contact with said belt.

12. The apparatus of claim 1, wherein the individual brush fibers are texturized having a crimp frequency of from about 4 to about 10 crimps per inch with an amplitude of from about 0.010 to 0.025 inches.

* * * * *